US006119673A

United States Patent [19]

Nakaura

[11] Patent Number: 6,119,673

[45] Date of Patent: Sep. 19, 2000

[54] WAFER RETRIEVAL METHOD IN MULTIPLE SLICING WIRE SAW

[75] Inventor: Kenichi Nakaura, Mitaka, Japan

[73] Assignee: Tokyo Seimitsu Co., Ltd., Tokyo, Japan

[21] Appl. No.: 09/203,097

[22] Filed: Dec. 2, 1998

[51] Int. Cl.[7] ..... B28D 1/02

[52] U.S. Cl. ..... 125/12; 125/16.02; 125/21

[58] Field of Search ..... 83/651.1; 125/16.01, 125/16.02, 21, 12; 451/339

[56] References Cited

U.S. PATENT DOCUMENTS

| | | | |
|---|---|---|---|
| 4,653,650 | 3/1987 | Schulke | 211/41 |
| 5,112,641 | 5/1992 | Harada et al. | 427/8 |
| 5,217,340 | 6/1993 | Harada et al. | 414/172 |
| 5,565,034 | 10/1996 | Nanbu et al. | 118/668 |
| 5,658,833 | 8/1997 | Chen et al. | 438/791 |
| 5,863,602 | 1/1999 | Watanabe et al. | 427/237 |
| 5,904,136 | 5/1999 | Nagatsuka et al. | 125/16.02 |
| 5,942,012 | 8/1999 | Kumasaka et al. | 29/25.01 |

*Primary Examiner*—Timothy V. Eley
*Attorney, Agent, or Firm*—Nixon Peabody LLP; David S. Safran

[57] ABSTRACT

Partitions are inserted between different kinds of wafers, which have been sliced from different kinds of ingots by a wire saw. The partitioned wafers are stored in a cassette, and are soaked in hot water with the cassette. The wafers are separated from slice base mounting beams. After the separation, the wafers are retrieved into the cassette in the state of being partitioned between the wafer lots.

12 Claims, 10 Drawing Sheets

50
Sa
Sb
Sc
M
W
Wa
W1
Wb
W2
Wc
42
44

50
Sa
Sb
Sc
M
W
Wa
W1
Wb
W2
Wc
42
44

50
M
Sa
Sb
Sc
W
Wa
W1
Wb
W2
Wc
42
44

50
Sa
Sb
Sc
M
W
Wa
Wb
Wc
P1
P2
42
44

50
Sa
Sb
Sc
M
W
Wa
Wb
Wc
P1
P2
42
44

50
M
S
Sa
Sb
Sc
W
Wa
Wb
Wc
P1
P2
42
44

WAFER RETRIEVAL METHOD IN MULTIPLE SLICING WIRE SAW

BACKGROUND OF THE INVENTION

1. Field of the Invention

The present invention relates generally to a wafer retrieval method in a multiple slicing wire saw, and more particularly to a wafer retrieval method in a multiple slicing wire saw which separates wafers, which were sliced simultaneously from different kinds of ingots by a wire saw, from slice base mounting beams to which the wafers are adhered, and retrieves the individual wafers.

2. Description of Related Art

An example of an ingot slicing apparatus is a wire saw. The wire saw presses an ingot against wire rows, which are running at a high speed, and supplies slurry to a contact area where the ingot is in contact with the wire rows to thereby slice the ingot into a number of wafers.

The wire saw normally slices one ingot in one slicing operation, but recently, a multiple cutting method has been adopted to slice a number of ingots at the same time in order to improve the slicing efficiency.

As shown in FIG. 10, a plurality of ingots Ia, Ib, Ic (three ingots are illustrated in FIG. 10) are adhered in series to the mounting plate M through slice base mounting beams Sa, Sb, Sc. In this method, a plurality of ingots can be sliced efficiently at the same time.

Incidentally, all the wafers, which have been sliced from the ingot by the wire saw, are adhered to the slice base mounting beams. Thus, it is necessary to separate the wafers from the slice base mounting beams after the slicing so that they can be individual wafers.

In a conventional separating method, the wafers are soaked in hot water so that they can be separated from the slice base mounting beams (a natural separating method). In this method, all the wafers are separated from the slice base mounting beams at the same time, and they are stored in a cassette, which is placed in a hot water tank.

In the conventional separating method, all the wafers are separated at the same time. For this reason, the separated wafers are mixed within the cassette, and different kinds of wafers are undistinguishable from one another.

SUMMARY OF THE INVENTION

The present invention has been developed in view of the above-described circumstances, and has as its object the provision of a wafer retrieval method in a multiple slicing wire saw, which retrieves wafers, which have been sliced from different lots of ingots at the same time by the wire saw, in each lot in the state wherein they are distinguishable from one another.

To achieve the above-mentioned object, the present invention is directed to a wafer retrieval method in a multiple slicing wire saw which comprises adhering different lots of workpieces to a mounting plate in series through a slice base mounting beams; mounting the mounting plate on a workpiece feed table; feeding the workpiece feed table toward wire rows to slice the different lots of workpieces pressed against the wire rows; separating sliced wafers from the slice base mounting beams to which the wafers are adhered to; and retrieving the wafers individually; the wafer retrieval method comprising the steps of: adhering partitions between the different lots of workpieces to the mounting plate through the slice base mounting beams; mounting the mounting plate to the workpiece feed table and slicing the different lots of workpiece together with the partitions at the same time; taking the mounting plate from the workpiece feed table after slicing; soaking all the wafers and partitions in hot water or chemical to separate them from the slice base mounting beams at the same time; and partitioning the wafers, having been separated from the slice base mounting beams, with the partitions separated from the slice base mounting beams between wafer lots.

According to the present invention, the partitions disposed between the workpieces are sliced by the wire rows with the workpieces, which are running with the workpiece. Since the partitions as well as the wafers are soaked in the hot water or medicine after the slicing, the partitions are also separated from the slice base mounting beams. The wafers are still partitioned after the separation, and thus, the different lots of wafers can be distinguished from one another.

To achieve the above-mentioned object, the present invention is directed to a wafer retrieval method in a multiple slicing wire saw which comprises slicing different lots of workpieces by a wire saw at the same time; separating the wafers from slice base mounting beams to which the wafers are adhered to; and retrieving the wafers individually; the wafer retrieval method comprising the steps of: inserting partitions between wafer lots sliced by the wire saw, and storing the wafers together with the partitions in a cassette; soaking the wafers with the cassette in hot water or medicine, and separating all the wafers from the slice base mounting beams at the same time; and retrieving the separated wafers into the cassette, and partitioning the wafers, retrieved into the cassette, between the wafer lots.

According to the present invention, the wafers adhered to the slice base mounting beams are stored in the cassette, and they are soaked in the hot water, so that the wafers can be separated naturally from the slice base mounting beams. After the separation, the wafers are retrieved into the cassette. The partitions are inserted between the wafer lots prior to the separation, the wafers are retrieved into the cassette in the state of being partitioned between the lots. Thus, according to the present invention, the wafers can be retrieved in each lot in the state wherein they are distinguishable from one another.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENT

This invention will be described in further detail by way of example with reference to the accompanying drawings.

A description will be given of the structure of a wire saw. The wire saw runs the wire rows, which are strung at a preset pitch, at a high speed, and presses a workpiece against the running wire rows while providing slurry (loose abrasives) to the wire rows, thus slicing the workpiece into a number of wafers.

Figure 1:
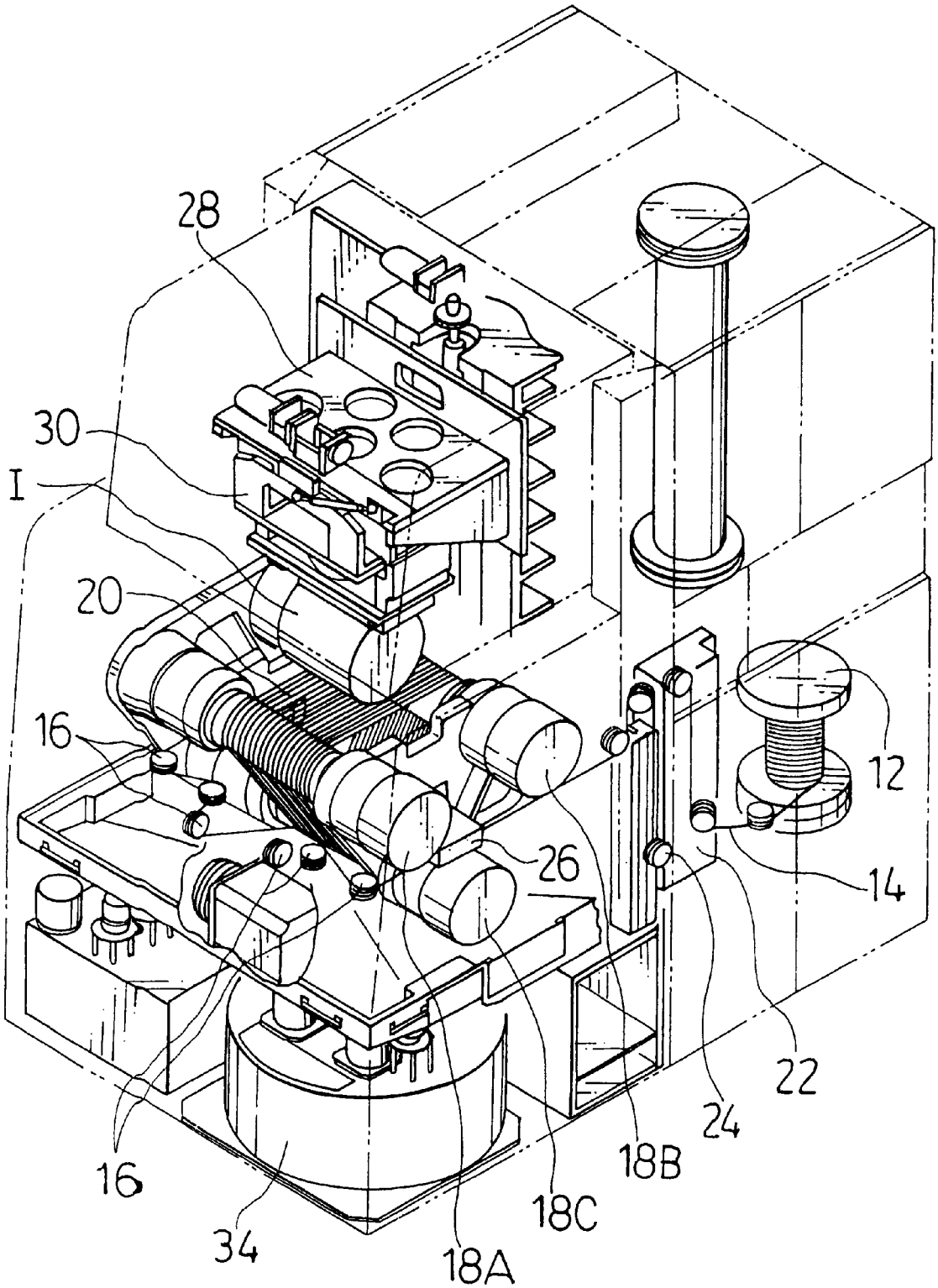
FIG. 1 is a view showing the entire structure of a wire saw.

FIG. 1 shows the entire structure of the wire saw. As shown in FIG. 1, the wire 14 wound around a wire reel 12 is wound on three grooved rollers 18A, 18B, 18C through a wire running route, which is formed by a plurality of guide rollers 16. After the grooved rollers 18A, 18B, 18C form the wire rows 20, the wire 14 is wound up by a wire reel (not illustrated) through a wire running route symmetrical with respect to the above-mentioned wire running route across the wire rows 20.

A wire guide apparatus 22, a dancer roller 24 and wire cleaning equipment 26 are arranged on the wire running routes at both sides of the wire rows 20 (only one side is illustrated). The wire guide apparatus 22 guides the wire 14 from the wire reel 12 at a constant pitch, and the dancer roller 24 applies a constant tension to the running wire 14. The wire cleaning equipment 26 removes the slurry, which is adhered to the wire 14 during the machining.

Motors (not illustrated) respectively connect to the pair of wire reels 12 and the grooved roller 18C, and running the motors causes the wire 14 to run at a high speed between the wire reels 12.

A workpiece feed table 28 is disposed above the wire rows 20, and the workpiece feed table 28 moves up and down vertically with respect to the wire rows 20. A holding apparatus 30, which holds an ingot I the workpiece, is arranged below the workpiece feed table 28. The ingot I is mounted on the bottom of the holding apparatus 30 through a mounting plate.

The wire saw 10, which is constructed in the above-mentioned manner, slices the ingot I as described below. First, the mounting plate, on which the ingot I (one ingot in this case) is mounted, is attached to the holding apparatus 30 of the workpiece feed table 28. After the attachment, the motor is run to cause the wire 14 to run at a high speed. Then, the workpiece feed table 28 moves downward toward the wire rows 20, and the ingot I is pressed against the wire rows 20, which are running at a high speed. The slurry is provided to a position where the ingot I comes into contact with the wire rows 20 through a nozzle (not illustrated). Consequently, the ingot I is sliced into wafers by the lapping operation of the abrasives included in the slurry.

In the above example, one ingot I is sliced in the above example. Three ingots Ia, Ib, Ic are sliced (multiple slicing) in a manner described below.

Figure 10B:
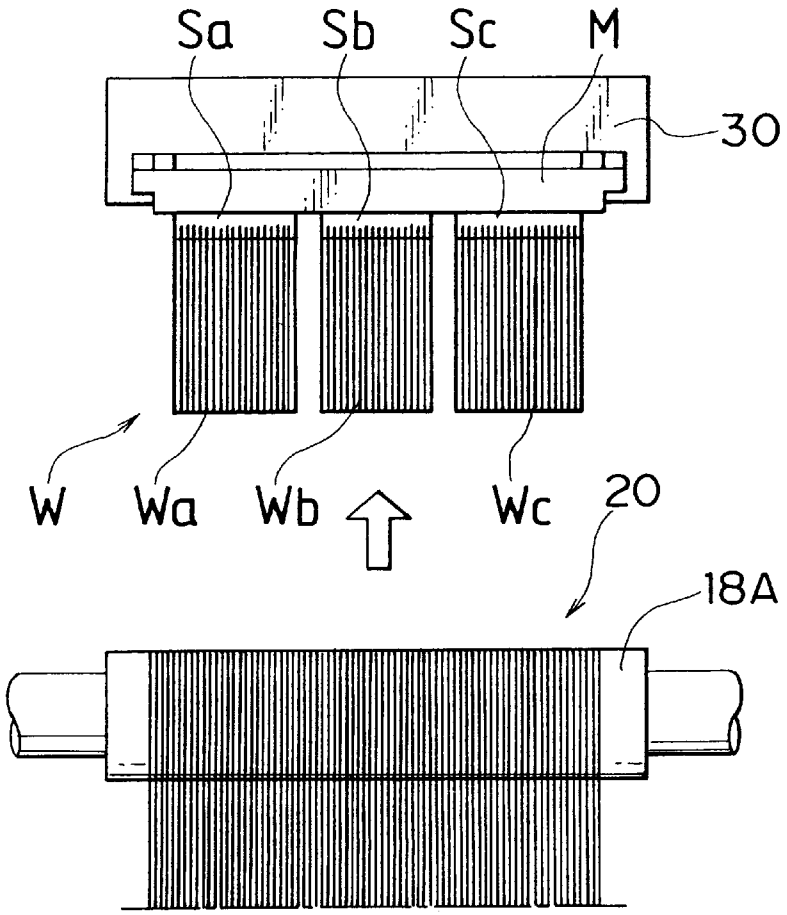
FIGS. 10(*a*) and 10(*b*) are views of assistance in explaining a slicing method in multiple slicing.
Figure 10A:
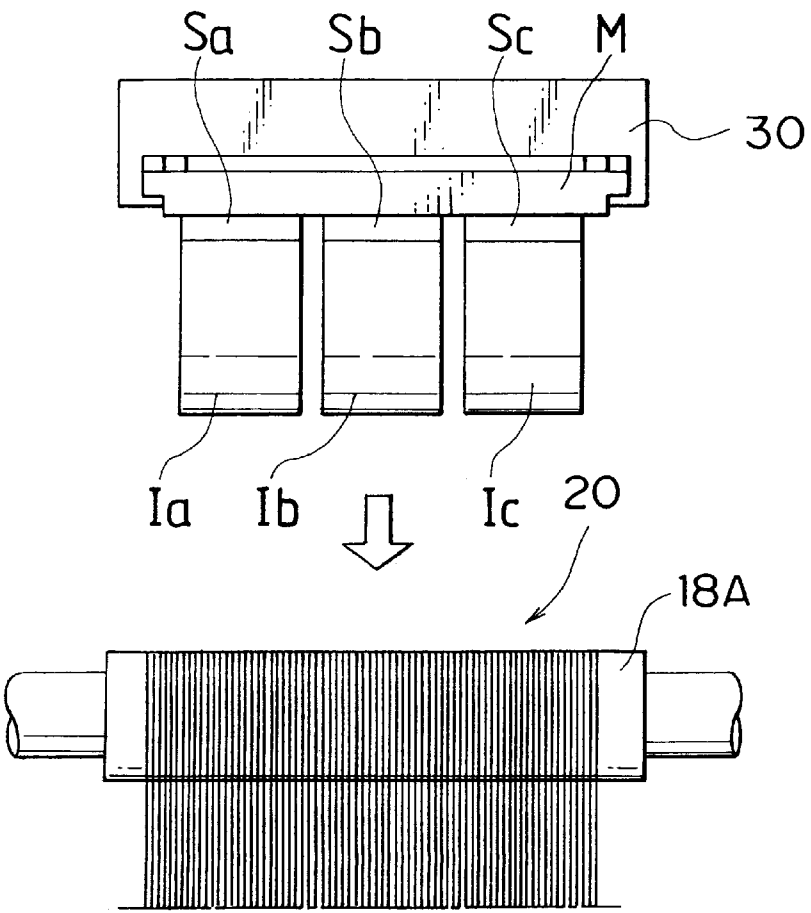

As shown in FIG. 10(*a*), three ingots Ia, Ib, Ic are adhered in series to the mounting plate M through slice base mounting beams Sa, Sb, Sc. Then, the mounting plate M is adhered to the holding apparatus 30 of the workpiece feed table 28. Thereafter, the same processing is performed as in the case when one ingot I is sliced. Specifically, as shown in FIG. 10(*b*), the workpiece feed table 28 is moved downward toward the wire rows 20, and the ingots Ia, Ib, Ic are pressed against the wire rows 20 which are running at a high speed. Thus, the three ingots Ia, Ib, Ic are sliced into a number of wafers at the same time.

The above slicing method has a disadvantage as follows. When the wafers are separated in a natural separating method after the slicing and are retrieved, the separated wafers are mixed in a cassette. Therefore, the wafers cannot be distinguished between the lots.

In the first embodiment of the wafer retrieval method in the multiple slicing wire saw according to the present invention, the ingots Ia, Ib, Ic are sliced and retrieved in a manner described below so that the separated wafers can be distinguished between the lots.

Figure 2:
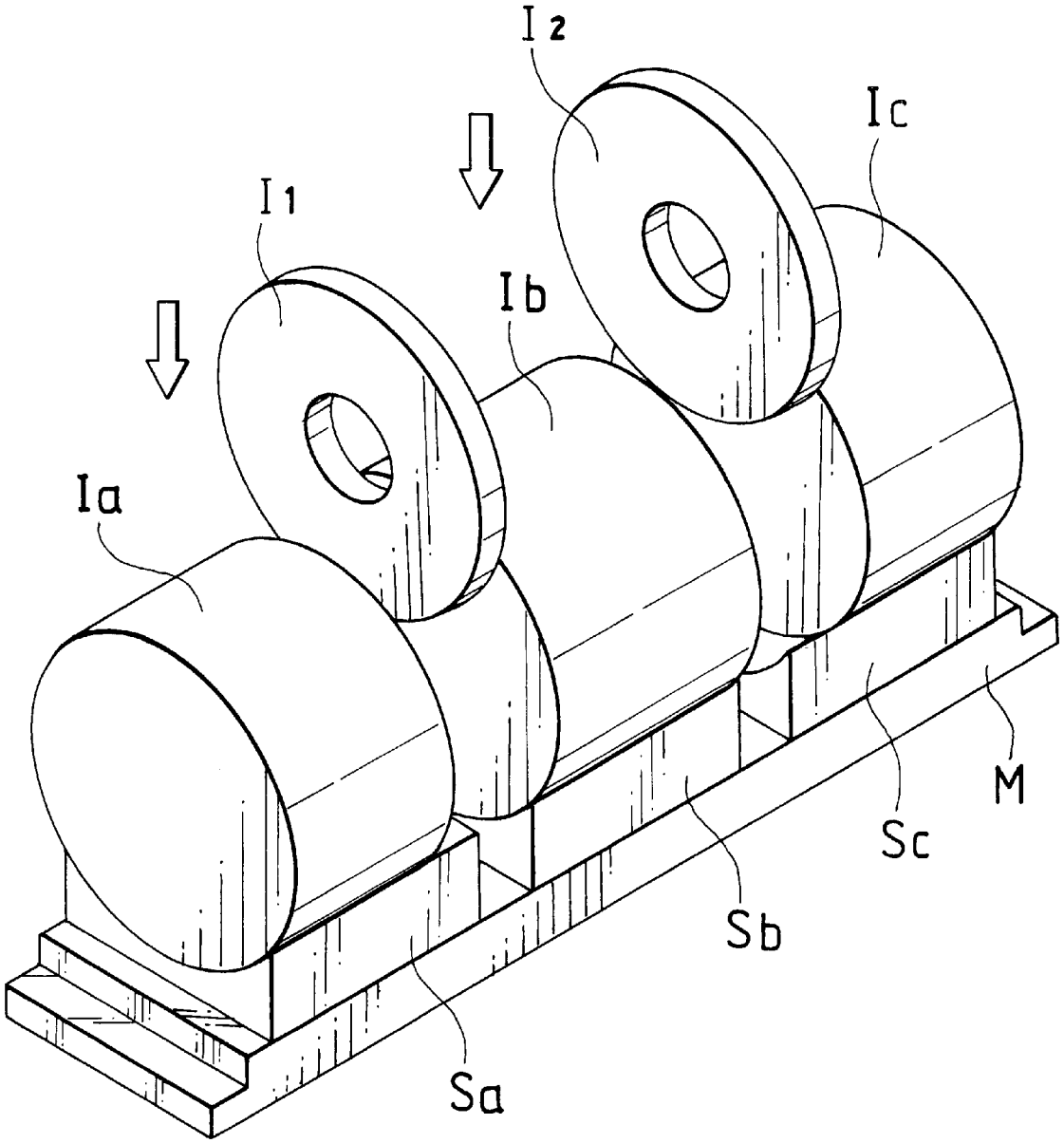
FIG. 2 is a view of assistance in explaining a method of attaching ingots and dummy ingots.

As shown in FIG. 2, the three ingots Ia, Ib, Ic are adhered to the mounting plate M through the slice base mounting beams Sa, Sb, Sc. Then, the ingots Ia, lb, Ic are partitioned by partitions $I_1$, $I_2$.

The partitions $I_1$, $I_2$ are doughnut-shaped and have the same diameter as the ingots Ia, Ib, Ic to be sliced. Their thickness is determined so that the wire saw can slice the partitions $I_1$, $I_2$ into about 5–10 wafers. The reason why the partitions $I_1$, $I_2$ are doughnut-shaped is that they are distinguishable from the wafers sliced from the ingots Ia, Ib, Ic.

The partitions $I_1$, $I_2$ are molded by the same or similar material as the ingots Ia, Ib, Ic to be sliced. If the ingots Ia, Ib, Ic to be sliced are made of silicon, the partitions $I_1$, $I_2$ are molded by silicon, or the brittle materials such as glass and ceramics.

The partitions $I_1$, $I_2$ are adhered to the mounting plate M through the slice base mounting beam as is the case with the ingots Ia, Ib, Ic. In this case, as shown in FIG. 2, the partition $I_1$ between the ingots Ia and lb (hereinafter referred to as "the first dummy ingot") is adhered to the slice base Sa, and the partition $I_2$ between the ingots Ib and Ic (hereinafter referred to as "the second dummy ingot") is adhered to the slice base Sc.

Figure 3B:
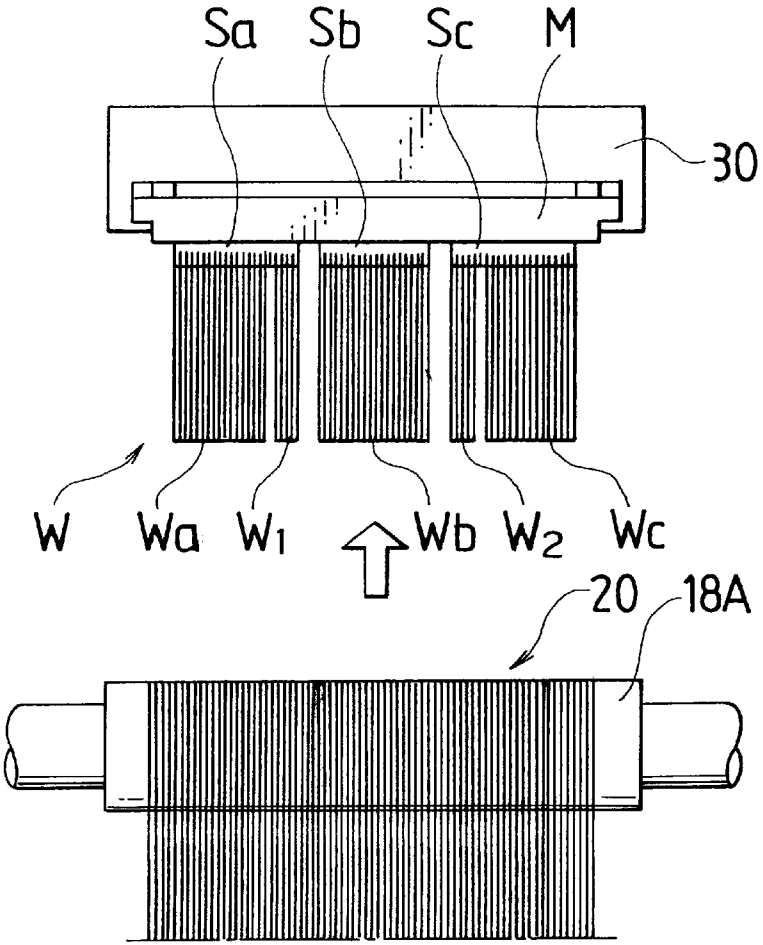
FIGS. 3(*a*) and 3(*b*) are views of assistance in explaining a method of slicing an ingot.
Figure 3A:
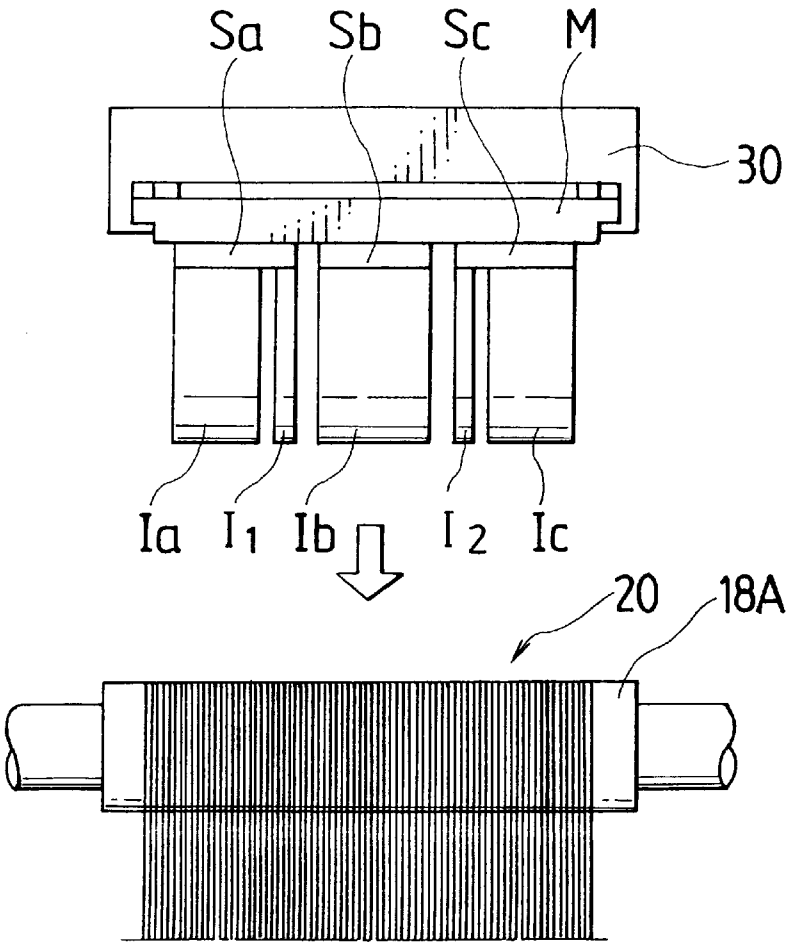

The wire saw 10 slices the ingots Ia, Ib, Ic which are partitioned by the dummy ingots $I_1$, $I_2$. Specifically, as shown in FIG. 3(*a*), the dummy ingots $I_1$, $I_2$ and the ingots Ia, Ib, Ic are adhered to the mounting plate M, which is attached to the holding apparatus 30 of the workpiece feed table 28. Then, the workpiece feed table 28 is moved down toward the wire rows 20, the ingots Ia, Ib, Ic and the dummy ingots $I_1$, $I_2$ are pressed against the wire rows 20, which are running at a high speed.

Consequently, three ingots Ia, Ib, Ic and the dummy ingots $I_1$, $I_2$ are sliced into a number of wafers at the same time as shown in FIG. 3(*a*). The wafers sliced from the ingot Ia are designated by Wa, the wafers sliced from the ingot lb are designated by Wb, and the wafers sliced from the ingot Ic are designated by Wc. The dummy wafers sliced from the dummy ingot $I_1$ are designated by $W_1$, and the dummy wafers sliced from the dummy ingot $I_2$ are designated by $W_2$. The word "wafers" without any marks indicates all kinds of wafers.

The sliced wafers W are adhered to the slice base mounting beam, they have to be separated from the slice base mounting beam to be individual wafers. The wafers W are separated in the natural separating method as described below.

First, a description will be given of the structure of a separating apparatus 40, which separates the wafers W from the slice base mounting beam.

Figure 4:
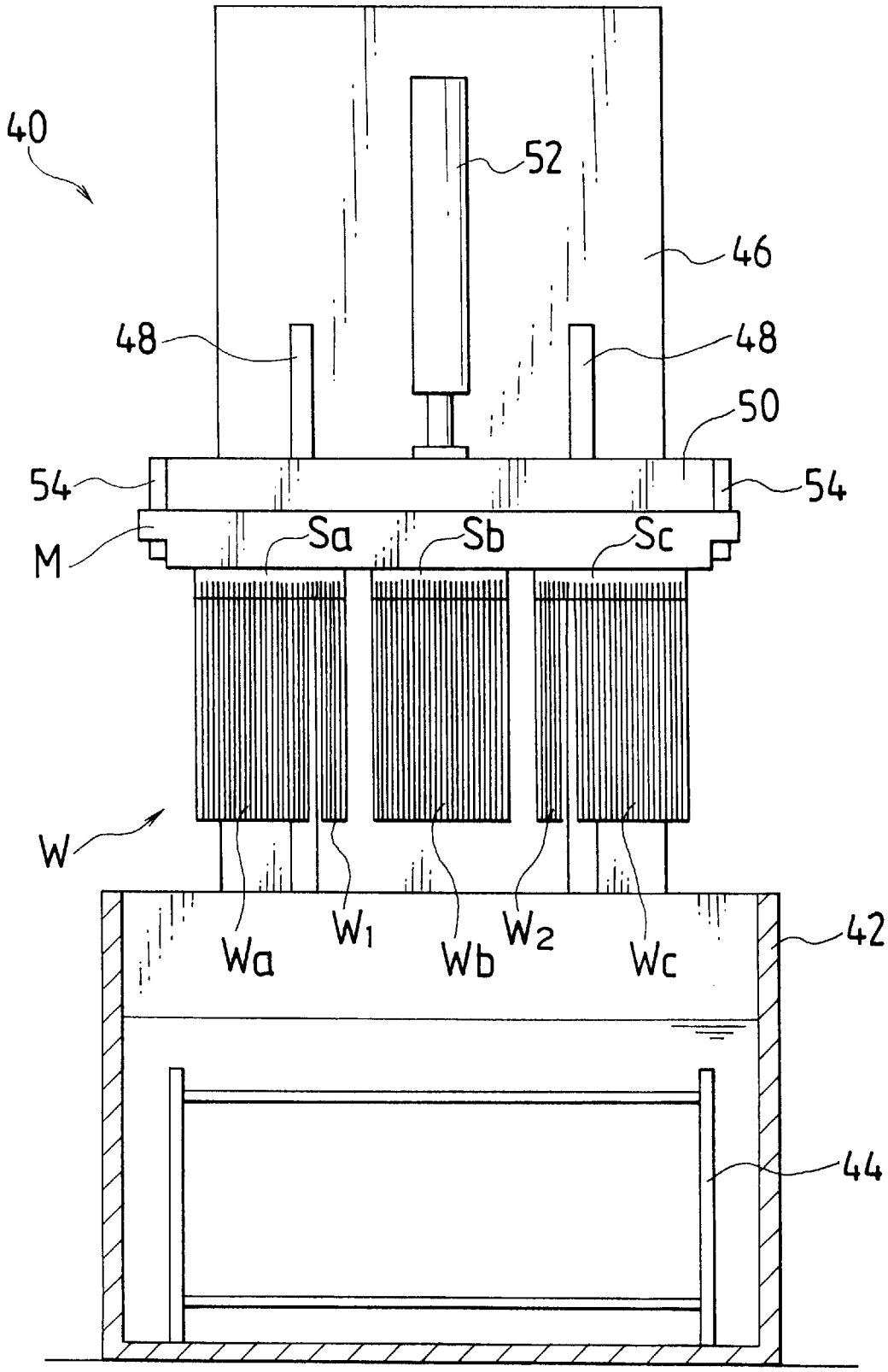
FIG. 4 is a front view illustrating the structure of a separating apparatus.

As shown in FIG. 4, the separating apparatus 40 has a hot water tank 42 which contains hot water of approximately 90° C. A cassette, which stores the wafers W, is placed in the hot water tank 42. The cassette 44 is fixed at a predetermined position in the tank through a lock means (not illustrated).

A prism-shaped column 46 stands vertically on the back of the hot water tank 42. A pair of guide rails 48 are formed in front of the column 46. A slider 50 is slidably supported on the guide rails 48. In front of the column 46, a hydraulic cylinder 52 is arranged along the guide rails 48. The slider 50 connects to a rod of the hydraulic cylinder 52. Driving the hydraulic cylinder 52 causes the slider 50 to move up and down along the guide rails 48.

A pair of L-shaped holding arms 54 are secured to both ends of the slider 50. Projections formed at both ends of the mounting plate M are placed on the holding arms 54. This causes the mounting plate M to be mounted in the separating apparatus 40.

When the mounting plate M is mounted in the separating apparatus 40 as described above, the wafers W attached to the mounting plate M are positioned just above the hot water tank 42. In this state, the hydraulic cylinder 52 is driven to move the slider 50 downward, so that the wafers W, which are stored in the cassette 44 in the hot water tank 42, can be soaked in the hot water.

The separating apparatus 40, which is constructed in the above-mentioned manner, separates the wafers W from the slice base mounting beams S in a manner described below.

First, an operator sets the wafers W, which have been sliced by the wire saw 10, in the separating apparatus 40. Specifically, the operator places the mounting plate M, to which the wafers W are attached, on the holding arms 54 of the separating apparatus 40.

Figure 5:
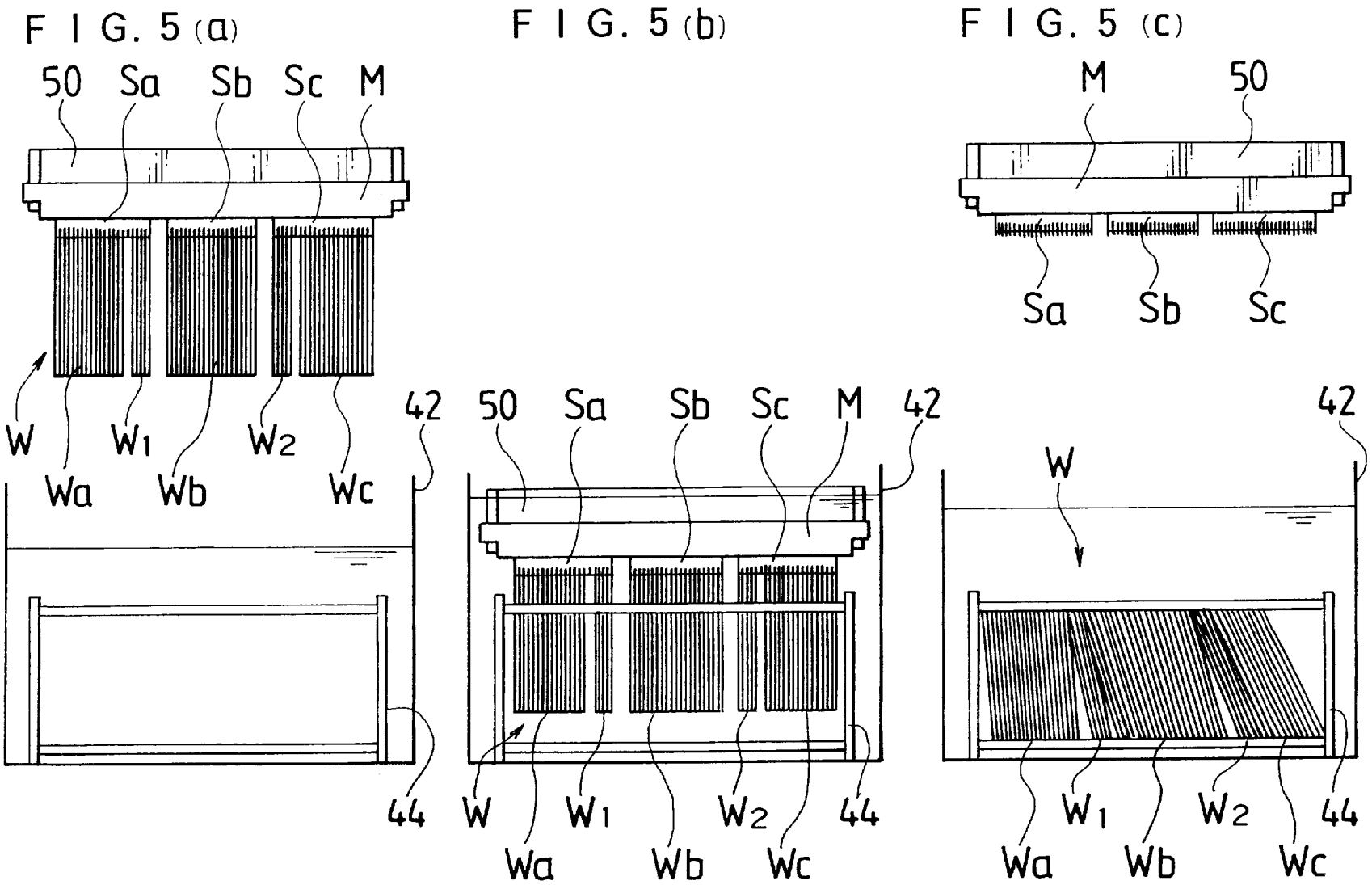
FIGS. 5(*a*), 5(*b*) and 5(*c*) are views of assistance in explaining a method of separating wafers.

FIG. 5(*a*) shows the state wherein the wafers W are set in the separating apparatus 40. In this state, the hydraulic cylinder 52 is driven to move the wafers W downward. Then, as shown in FIG. 5(*b*), the wafers W are soaked in the hot water. At this time, the wafers W are stored in the cassette 44 and are floating a predetermined height from the bottom of the hot water tank 42.

After a short time, an adhesive for adhering the wafers W to the slice base mounting beams S becomes softer due to the heat, and the wafers W fall from the slice base mounting beams S due to their deadweight. The fallen wafers W are stored in the cassette 44.

When all the wafers W are separated, the operator drives the hydraulic cylinder 52 to lift the slider 50. As shown in FIG. 5(*c*), the slider 50 is lifted with the mounting plate M and the slice base mounting beams Sa, Sb, Sc which are adhered to the mounting plate M. After the slider 50 is lifted, the operator takes the wafers W with the cassette 44 from the hot water tank 42.

Figure 6:
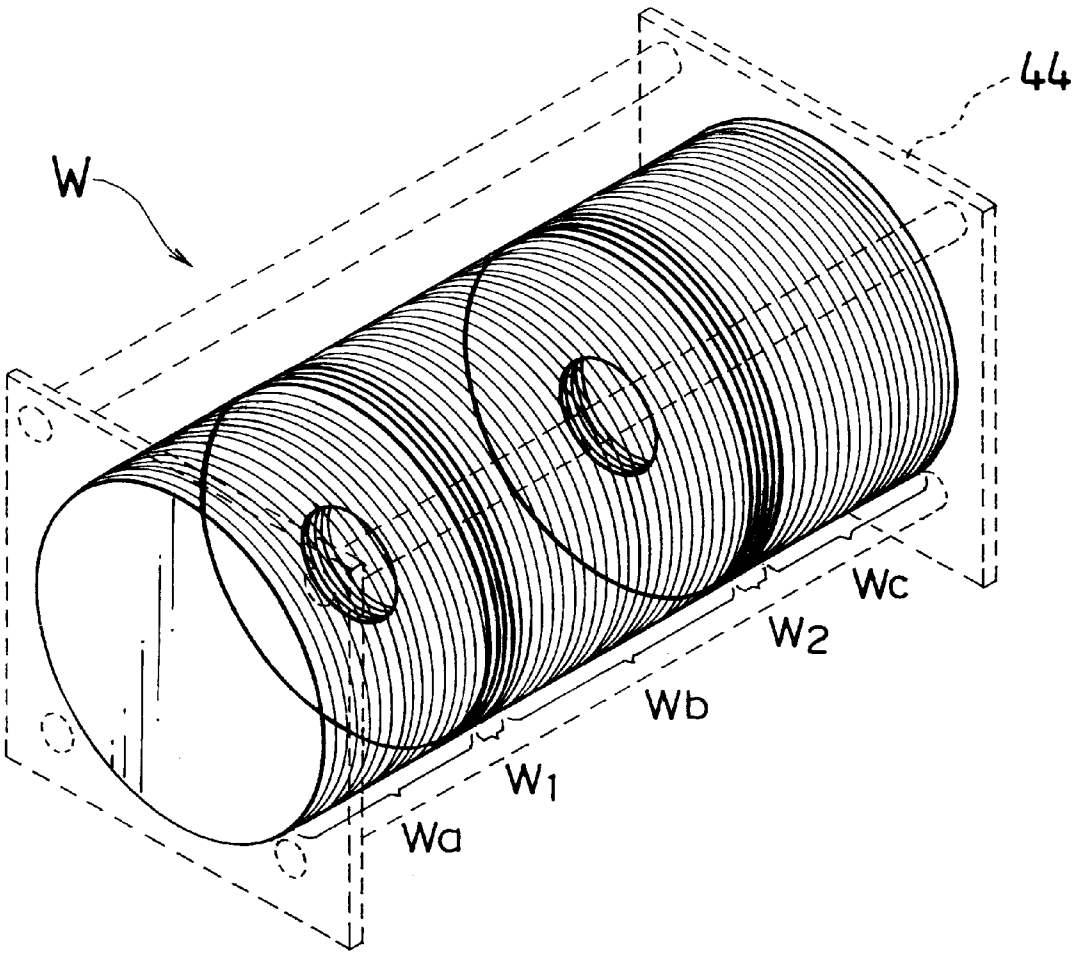
FIG. 6 is a view of assistance in explaining the state wherein wafers are retrieved.

FIG. 6 shows the cassette 44 which has been taken from the hot water tank 42. As shown in FIG. 6, the wafers Wa, Wb, Wc separated from the slice base mounting beams are stored in the cassette 44 in the state wherein the wafers Wa, Wb, Wc are partitioned by the dummy wafers $W_1$, $W_2$ between the lots.

The operator can recognize the boundaries between the wafers Wa, Wb, Wc with the dummy wafers $W_1$, $W_2$. Since the dummy wafers $W_1$, $W_2$ are doughnut-shaped, the operator can easily find them.

In the method of retrieving wafers in the wire saw according to the first embodiment, there is no such problem that the wafers Wa, Wb, Wc, which are naturally separated in the hot water, are mixed in the cassette 44 and they cannot be distinguished from one another.

In this embodiment, the dummy ingots $W_1$, $W_2$ are doughnut-shaped, but any shape is acceptable if the dummy ingots $W_1$, $W_2$ can be distinguished from wafers Wa, Wb, Wc after the slicing. For example, the sectional shape of the dummy ingots $W_1$, $W_2$ may be a polygon such as a hexagon and an octagon, or a number of holes may be punched in them.

The dummy ingots $W_1$, $W_2$ may also be distinguished from the wafers Wa, Wb, Wc by color.

Considering the slicing resistance, the thermal deformation, etc., the dummy ingots $W_1$, $W_2$ are preferably made of the same or similar material to the ingots Ia, Ib, Ic subject to slicing, and they are preferably shaped similarly to the ingots Ia, Ib, Ic subject to the slicing.

In the first embodiment, the operator retrieves the wafers which have been separated from the slice base mounting beams. On the other hand, the wafers are automatically retrieved as described below.

To automatically retrieve the wafers W, the wafers W are retrieved one by one from the cassette 44 with the use of a vacuum pad, etc. A CCD camera, etc. image the wafers retrieved from the cassette 44 one by one. The imaging data is image-processed to detect the dummy wafers $W_1$, $W_2$. Since the dummy wafers $W_1$, $W_2$ are the boundaries between the lots, the different kinds of wafers can be distinguished from one another. By changing the retrieval cassettes, etc. the wafers can be retrieved without such a problem that different kinds of wafers are mixed with one another in the automatic retrieval.

In this embodiment, the wafers are soaked in hot water, and the adhesive between the wafers and the slice base mounting beams is softened by heat so that the wafers can be separated from the slice base mounting beams. The present invention, however, should not be restricted to this. The sliced wafers may also be soaked in chemical (e.g., acetic acid) so that the wafers can be separated from the slice base mounting beams.

A description will be given of the second embodiment for the wafer retrieval method in the multiple slicing wire saw according to the present invention.

In the above-mentioned wafer retrieval method of the first embodiment, the dummy ingots $I_1$, $I_2$ are inserted between the ingots Ia, Ib, Ic prior to the slicing, and the ingots Ia, Ib, Ic are sliced so that they can be distinguished from one another.

Figure 7:
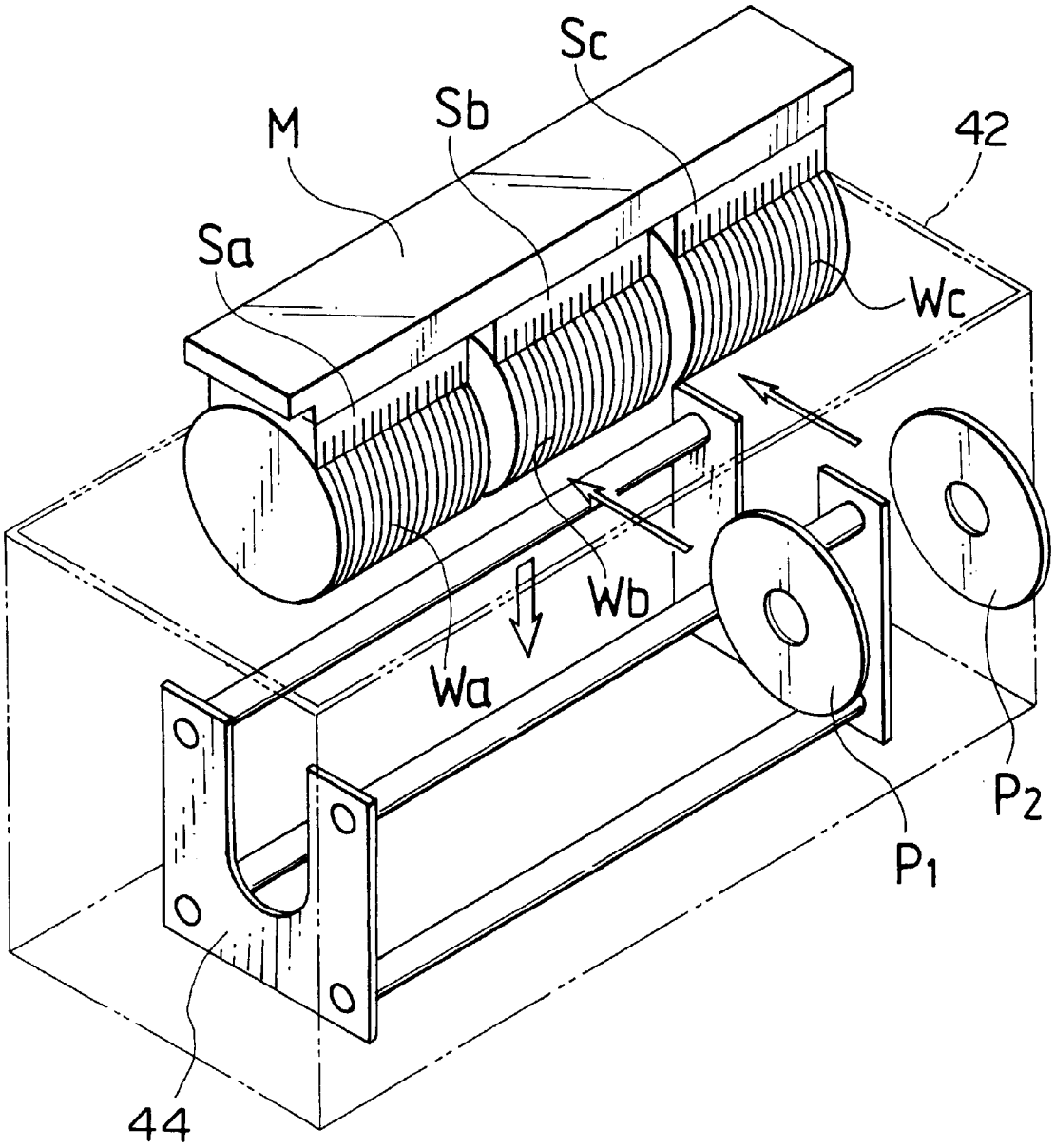
FIG. 7 is a view of assistance in explaining a method of retrieving wafers.

On the other hand, in the second embodiment of the wafer retrieval method, the partitions are inserted between the lots of the wafers after the slicing, and the wafers are separated in this state, so that they can be distinguished from one another. As shown in FIG. 7, the partitions $P_1$, $P_2$ are inserted between the wafers Wa, Wb, Wc. The wafers Wa, Wb, Wc are soaked in the hot water in this state.

The ingots Ia, Ib, IC are sliced in the same manner as the normal multiple slicing. Specifically, as shown in FIG. 10, the ingots Ia, Ib, Ic are adhered in series to the mounting plate M through the slice base mounting beams Sa, Sb, Sc, and the mounting plate M is attached to the wire saw so that a plurality of ingots Ia, Ib, Ic can be sliced at the same time.

In the second embodiment, the separating apparatus 40 described in the first embodiment is used to separate the wafers (see FIG. 4).

First, the operator sets the wafers W sliced by the wire saw 10 in the separating apparatus 40. Specifically, the operator places the mounting plate M, to which the wafers W are attached, on the holding arms 54 of the separating apparatus 40.

Figure 8:
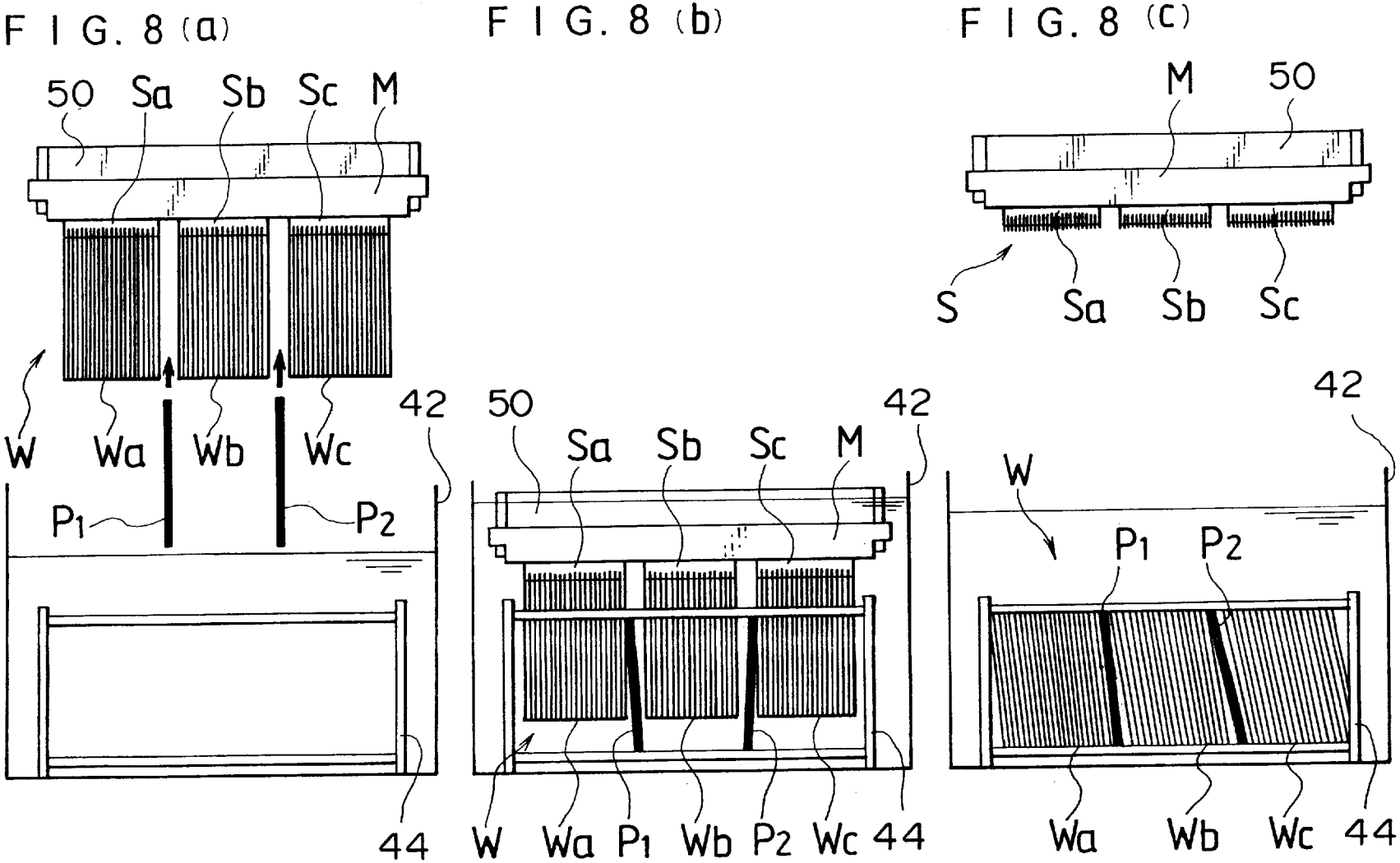
FIGS. 8(*a*), 8(*b*) and 8(*c*) are views of assistance in explaining a method of retrieving wafers.

As shown in FIG. 8(*a*), the partitions $P_1$, $P_2$ are inserted between the wafers Wa, Wb, Wc.

The partitions $P_1$, $P_2$ are shaped like a doughnut with substantially the same thickness and diameter as the separated wafers Wa, Wb, Wc. The reason why the partitions $P_1$, $P_2$ are shaped like a doughnut is that they are distinguishable from the wafers Wa, Wb, Wc after the separation. The partitions $P_1$, $P_2$ are preferably made of a material which is not deformed by heat since they are soaked in the hot water with the wafers W. After the partitions $P_1$, $P_2$ are inserted between the wafers Wa, Wb, Wc, the hydraulic cylinder 52 is driven. Then, as shown in FIG. 8(*b*), the partitions $P_1$, $P_2$ as well as the wafers Wa, Wb, Wc are soaked in the hot water.

At this time, the wafers W are contained in the cassette 44 which is set in the hot water tank 42 in advance. The wafers W are floating in the hot water at a predetermined height from the bottom of the hot water tank 42. Then, the partitions $P_1$, $P_2$, which are inserted between the wafers Wa, Wb, Wc, are stored in the cassette 44.

After a short time, the adhesive between the wafers W and the slice base mounting beams S is softened. Consequently, the wafers W are separated from the slice base mounting beams S due to their deadweight. The separated wafers W fall into the cassette 44.

As shown in FIG. 8(*b*), the partitions $P_1$, $P_2$ are inserted between the wafers Wa, Wb, Wc in the cassette 44 in advance, and therefore, the wafers Wa, Wb, Wc are stored in the cassette 44 in the state of being partitioned by the partitions $P_1$, $P_2$ even after the wafers W are separated from the slice base mounting beams S.

The separation is completed when all the wafers W are separated from the slice base mounting beams S. As shown in FIG. 8(*c*), the operator drives the hydraulic cylinder 52 to lift the slider 50. After lifting the slider 50, the operator takes the wafers W with the cassette 44 from the hot water tank 42.

Figure 9:
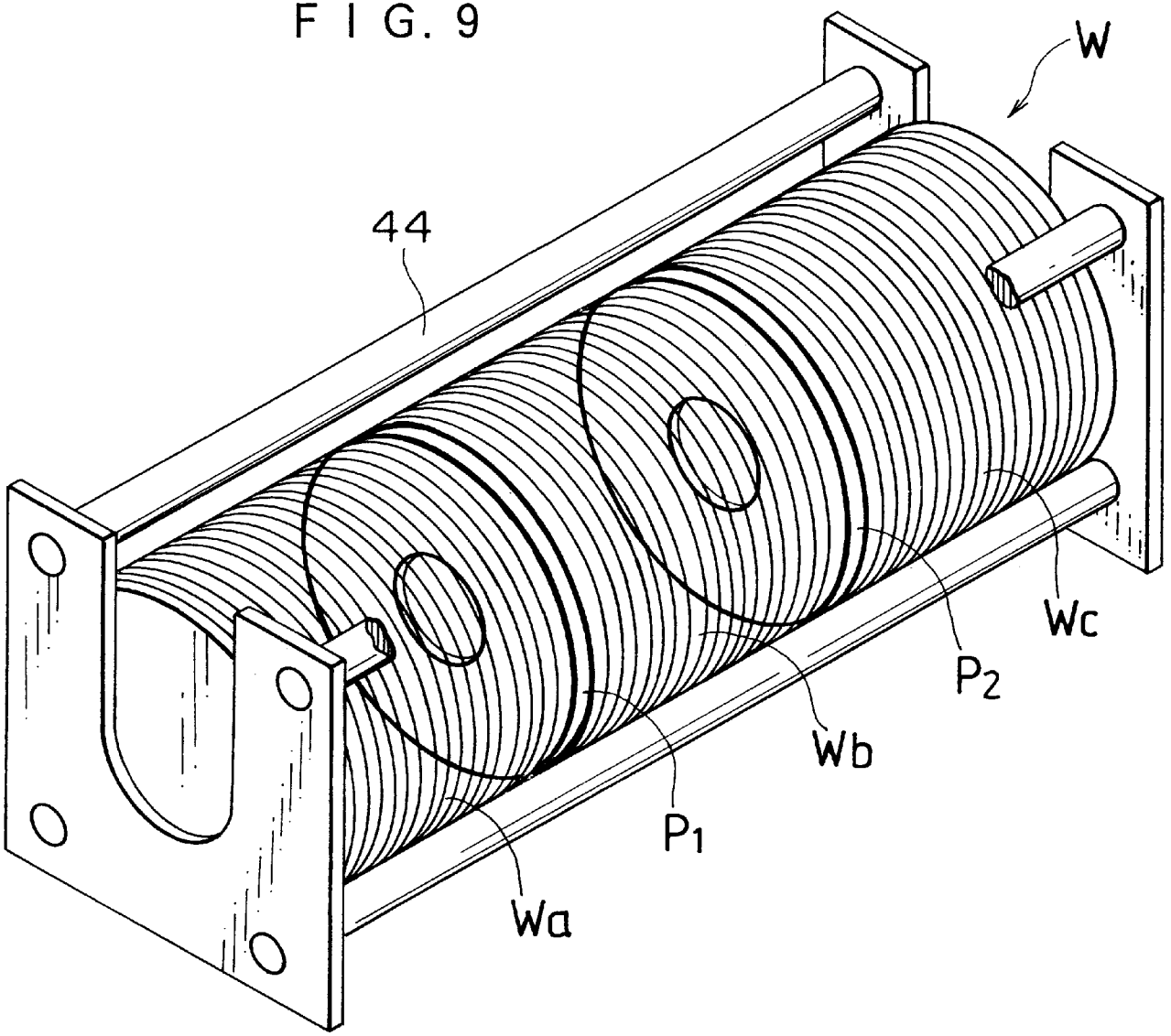
FIG. 9 is a view of assistance in explaining the state wherein wafers are retrieved.

FIG. 9 shows the state of the cassette 44, which has been taken from the hot water tank 42. As shown in FIG. 9, the wafers Wa, Wb, Wc are stored in the cassette 44 in the state of being partitioned by the partitions $P_1$, $P_2$.

The operator can recognize the boundaries between the wafers Wa, Wb, Wc with the partitions $P_1$, $P_2$. Since the partitions $P_1$, $P_2$ are doughnut-shaped unlike the wafers Wa, Wb, Wc, the operator can easily find them.

In the method of retrieving wafers in the wire saw according to the second embodiment, the multiply-sliced wafers Wa, Wb, Wc are distinguishable from one another even if they are soaked in the hot water to be separated naturally.

In the second embodiment, the partitions $P_1$, $P_2$ are doughnut-shaped, but any shape is acceptable if they can be distinguished from wafers Wa, Wb, Wc. For example, the sectional shape of the partitions $P_1$, P2 may be a polygon such as a hexagon and an octagon, or a number of holes may be punched in them.

The partitions $P_1$, $P_2$ may also be distinguished from the wafers Wa, Wb, Wc by color.

The wafer retrieval method of the second embodiment can achieve an effect as described below. When the wire saw slices the ingot, inferior wafers are sliced from both ends of the ingot. The ingot is inclined at a predetermined angle with respect to the wire rows during the slicing so that the ingot can be sliced in a predetermined crystal orientation, and therefore, crescent-shaped wafers and chipped wafers are sliced from both ends of the ingot. Since these inferior wafers cannot be sold on the market, the operator must remove them after the wafers are separated from the slice base mounting beams. In the wafer retrieval method of the second embodiment, however, the boundaries between wafers Wa, Wb, Wc can be recognized easily, and the inferior wafers can also be found easily.

In the above processing, it is dangerous for the operator to handle the wafers W of extremely high temperature just after they are taken from the hot water tank 42. For this reason, the wafers W, which have been taken from the hot water tank 42, as well as the cassette 44, are soaked in cold water before the processing.

In the second embodiment, the operator retrieves the wafers, which have been sliced from the slice base mounting beams. The wafers are retrieved automatically in a manner described below.

To automatically retrieve the wafers W, the wafers W are retrieved from the cassette 44 one by one with the use of a vacuum pad, etc., and an imaging means such as a CCD camera images the wafers W, which have been taken from the cassette 44, one by one. Then, the image data is image-processed to thereby detect that the partitions $P_1$, $P_2$ have been retrieved. Since the partitions $P_1$, $P_2$ are the boundaries between the wafers Wa, Wb, Wc, the different kinds of wafers can be distinguished. By changing the retrieval cassettes, etc., it is possible to retrieve the wafers without mixing different kinds of wafers even in the automatic retrieval.

In an apparatus which retrieves the wafers from the cassette sequentially (e.g., a chamfering apparatus and a polishing apparatus), the boundaries between the wafer lots can be recognized by detecting the partitions $P_1$, $P_2$ among the wafers. Thus, even if the different kinds of wafers are stored in the same cassette, the wafers of each kind can be processed continuously.

In the second embodiment, the wafers are soaked in the hot water, and the adhesive between the wafers and the slice base mounting beams is softened to separate the wafers from the slice base mounting beams, but the present invention should not be restricted to this. For instance, the wafers may be soaked in chemical (e.g., acetic acid) after the slicing, so that the wafers can be separated from the slice base mounting beams.

As set forth hereinabove, when the wire saw slices different kinds of workpiece, the different kinds of wafers are not mixed in the retrieval.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A wafer retrieval method in a multiple slicing wire saw which comprises adhering different lots of workpieces to slice base mounting beams so that said different lots of workpieces are positioned on a mounting plate in series; mounting said mounting plate on a workpiece feed table; feeding said workpiece feed table toward wire rows to slice said different lots of workpieces pressed against said wire rows into sliced wafers; separating said wafers from said slice base mounting beams to which the wafers are adhered to; and retrieving the wafers individually; said wafer retrieval method comprising the steps of:

adhering a partition between said different lots of workpieces to said slice base mounting beams on said mounting plate through said slice base mounting beams;

mounting said mounting plate to said workpiece feed table and slicing said different lots of workpiece together with said partition at the same time;

taking said mounting plate from said workpiece feed table after slicing;

soaking all the wafers and partition in hot water or chemical to separate them from said slice base mounting beams at the same time; and partitioning the wafers, having been separated from said slice base mounting beams, with the partition separated from said slice base mounting beams between wafer lots.

2. The wafer retrieval method in the multiple slicing wire saw as defined in claim 1, wherein said partition is of material which has at least similar slicing characteristics as said workpieces, and wherein said partition has a sectional shape which is different from that of said workpieces.

3. The wafer retrieval method in the multiple slicing wire saw as defined in claim 2, wherein said partition is of a different color than said workpieces.

4. The wafer retrieval method in the multiple slicing wire saw as defined in claims 1, wherein said partition is shaped differently from the wafers and is made of material which has at least similar slicing characteristics as said workpieces.

5. The wafer retrieval method in the multiple slicing wire saw as defined in claim 4, wherein said partition is of a different color than said workpieces.

6. The wafer retrieval method in the multiple slicing wire saw as defined in claim 1, wherein said partition is of a different color than said workpieces.

7. A wafer retrieval method in a multiple slicing wire saw which comprises slicing different lots of workpieces by a wire saw at the same time into sliced wafers of different lots; separating said wafers from slice base mounting beams to which the wafers are adhered to; and retrieving the wafers individually; said wafer retrieval method comprising the steps of:

inserting a partition between wafer lots sliced by said wire saw, and storing the wafers together with said partition in a cassette;

soaking the wafers with said cassette in hot water or chemical, and separating all the wafers from said slice base mounting beams at the same time; and retrieving the separated wafers into said cassette, and partitioning the wafers, retrieved into said cassette, between the wafer lots.

8. The wafer retrieval method in the multiple slicing wire saw as defined in claim 7, wherein said partition is made of material which has at least similar slicing characteristics as said workpieces, and wherein said partition has a sectional shape which is different from that of said workpieces.

9. The wafer retrieval method in the multiple slicing wire saw as defined in claim 8, wherein said partition is of a different color than said workpieces.

10. The wafer retrieval method in the multiple slicing wire saw as defined in claim 7, wherein said partition is shaped differently from the wafers and is made of material which has at least similar slicing characteristics as said workpieces.

11. The wafer retrieval method in the multiple slicing wire saw as defined in claim 10, wherein said partition is of a different color than said workpieces.

12. The wafer retrieval method in the multiple slicing wire saw as defined in claim 7, wherein said partition is of a different color than said workpieces.

* * * * *